US006129220A

United States Patent [19]

Decossas

[11] Patent Number: 6,129,220

[45] Date of Patent: Oct. 10, 2000

[54] MULTI-STATION ORGANIZER AND SPORTS BOTTLE HOLDER

[76] Inventor: Joann Gail Decossas, 201 Sixth St., Chalmette, La. 70043

[21] Appl. No.: 09/036,419

[22] Filed: Mar. 5, 1998

[51] Int. Cl.[7] ..... A47F 7/00; A47G 23/02

[52] U.S. Cl. ..... 211/85.7; 211/86.01; 211/87.01; 211/13.1; 248/223; 248/220.41; 248/220.31

[58] Field of Search ..... 211/85.7, 86.01, 211/87.01, 106, 13.1, 59.1, 71.01, 107; 248/311.2, 220.41, 220.31, 220.42, 220.43, 227.3, 230.1, 218.4, 219.4, 219.3, 313

[56] References Cited

U.S. PATENT DOCUMENTS

| | | | |
|---|---|---|---|
| 843,633 | 2/1907 | Schoonmaker | 211/87.01 X |
| 1,801,453 | 4/1931 | Patterson | 248/220.31 X |
| 2,279,442 | 4/1942 | Burns et al. | 248/311.2 |
| 2,614,701 | 11/1952 | Mapson | 211/87.01 |
| 2,880,953 | 4/1959 | Dicks | 248/311.2 X |
| 2,883,134 | 4/1959 | O'Halloran | 248/311.2 X |
| 2,923,417 | 2/1960 | Sonksen | D6/454 X |
| 2,950,011 | 8/1960 | Hemphill | 248/220.41 X |
| 3,131,900 | 5/1964 | Anderson et al. | 248/311.2 X |
| 3,198,469 | 8/1965 | Callanan | 248/220.41 X |
| 3,502,294 | 3/1970 | Kalbow et al. | 248/311.2 X |
| 3,532,318 | 10/1970 | Lloyd | 248/311.2 |
| 3,672,621 | 6/1972 | Bambenek | 211/59.1 X |
| 3,750,893 | 8/1973 | Kempler | 211/175 X |
| 3,785,501 | 1/1974 | Canning | 211/57 X |
| 3,868,864 | 3/1975 | Durkee et al. | 248/230.1 X |
| 3,871,608 | 3/1975 | Ogden | 248/223.1 X |
| 3,921,948 | 11/1975 | Long | 248/223.1 |
| 3,928,929 | 12/1975 | Forte | 248/230.1 X |
| 4,114,861 | 9/1978 | Long | 248/219.4 X |
| 4,166,601 | 9/1979 | Kato | 248/230.1 X |
| 4,182,505 | 1/1980 | Cobin | 248/220.41 |
| 4,258,892 | 3/1981 | Craine | 248/220.41 |
| 4,304,382 | 12/1981 | Jelen | 248/220.41 X |
| 4,322,006 | 3/1982 | Marschak | 248/220.41 X |
| 4,461,443 | 7/1984 | Dauman | 248/220.31 |
| 4,480,755 | 11/1984 | Cartwright | 211/163 X |
| 4,516,681 | 5/1985 | Jahel | 211/59.1 |
| 4,523,722 | 6/1985 | Cohen et al. | 211/175 |
| 4,606,437 | 8/1986 | Everett | 248/220.31 X |
| 4,645,154 | 2/1987 | Bly | 248/220.41 |
| 4,681,233 | 7/1987 | Roth | 211/87.01 X |
| 4,708,311 | 11/1987 | Clausen et al. | 248/220.31 X |
| 4,723,880 | 2/1988 | Stumpf, Jr. | 211/87.01 X |
| 4,892,281 | 1/1990 | Difilippo et al. | 248/311.2 |
| 5,012,997 | 5/1991 | Hutchison | 211/59.1 X |
| 5,035,388 | 7/1991 | Nagel | 248/220.31 X |
| 5,065,290 | 11/1991 | Makar et al. | 248/220.41 X |
| 5,083,668 | 1/1992 | Bushey | 211/87.01 X |
| 5,152,441 | 10/1992 | Torena | 224/210 |
| 5,180,128 | 1/1993 | Massey | 248/220.41 |
| 5,259,579 | 11/1993 | Scheider | 248/311.2 |
| 5,335,471 | 8/1994 | Kupiec | 52/727 |
| 5,556,068 | 9/1996 | Gorelik | 248/220.41 |
| 5,718,403 | 2/1998 | Ott et al. | 248/219.4 X |
| 5,772,047 | 6/1998 | Bostjancic | 211/13.1 |
| 5,823,360 | 10/1998 | Gorosave | 211/87.01 X |

FOREIGN PATENT DOCUMENTS

| | | | |
|---|---|---|---|
| 837829 | of 0000 | Switzerland | 248/220.31 |
| 248999 | 5/1947 | Switzerland | 248/220.31 |

*Primary Examiner*—Daniel P. Stodola
*Assistant Examiner*—Khoa Tran

[57] ABSTRACT

A multi-station organizer and sports bottle holder for storing handles, straps, and bars that are used to perform different exercises on a multi-purpose exercise machine includes a section of peg board having a generally rectangular configuration. A mounting bracket is secured to a back surface of the section of peg board for securement of the section of peg board to a frame of a multi-purpose exercise machine. A set of pegs and hooks couple with the peg board for hanging equipment on the peg board. A sports bottle holder is adapted for coupling with the peg board for holding a beverage container on the peg board.

4 Claims, 3 Drawing Sheets

MULTI-STATION ORGANIZER AND SPORTS BOTTLE HOLDER

BACKGROUND OF THE INVENTION

1. Field of the Invention

The present invention relates to peg board displays and more particularly pertains to a new multi-station organizer and sports bottle holder for storing handles, straps, and bars that are used to perform different exercises on a multi-purpose exercise machine.

2. Description of the Prior Art

The use of peg board displays is known in the prior art. More specifically, peg board displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art peg board displays include U.S. Pat. No. 4,106,629 to Doyle et al.; U.S. Pat. No. 5,423,509 to LaPorte et al.; U.S. Pat. No. Des. 320,719 to Kolsrud et al.; U.S. Pat. No. 5,094,352 to Green Sr. et al.; U.S. Pat. No. 5,415,371 to Kirchner; and U.S. Pat. No. 5,429,334 to Hutchison.

While these devices fulfill their respective, particular objectives and requirements, the aforementioned patents do not disclose a new multi-station organizer and sports bottle holder. The inventive device includes a section of peg board having a generally rectangular configuration. A mounting bracket is secured to a back surface of the section of peg board for securement of the section of peg board to a frame of a multi-purpose exercise machine. A set of pegs and hooks couple with the peg board for hanging equipment on the peg board. A sports bottle holder is adapted for coupling with the peg board for holding a beverage container on the peg board.

In these respects, the multi-station organizer and sports bottle holder according to the present invention substantially departs from the conventional concepts and designs of the prior art, and in so doing provides an apparatus primarily developed for the purpose of storing handles, straps, and bars that are used to perform different exercises on a multi-purpose exercise machine.

SUMMARY OF THE INVENTION

In view of the foregoing disadvantages inherent in the known types of peg board displays now present in the prior art, the present invention provides a new multi-station organizer and sports bottle holder construction wherein the same can be utilized for storing handles, straps, and bars that are used to perform different exercises on a multi-purpose exercise machine.

The general purpose of the present invention, which will be described subsequently in greater detail, is to provide a new multi-station organizer and sports bottle holder apparatus and method which has many of the advantages of the peg board displays mentioned heretofore and many novel features that result in a new multi-station organizer and sports bottle holder which is not anticipated, rendered obvious, suggested, or even implied by any of the prior art peg board displays, either alone or in any combination thereof.

To attain this, the present invention generally comprises a section of peg board having a generally rectangular configuration. A mounting bracket is secured to a back surface of the section of peg board for securement of the section of peg board to a frame of a multi-purpose exercise machine. A set of pegs and hooks couple with the peg board for hanging equipment on the peg board. A sports bottle holder is adapted for coupling with the peg board for holding a beverage container on the peg board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new multi-station organizer and sports bottle holder apparatus and method which has many of the advantages of the peg board displays mentioned heretofore and many novel features that result in a new multi-station organizer and sports bottle holder which is not anticipated, rendered obvious, suggested, or even implied by any of the prior art peg board displays, either alone or in any combination thereof.

It is another object of the present invention to provide a new multi-station organizer and sports bottle holder which may be easily and efficiently manufactured and marketed.

It is a further object of the present invention to provide a new multi-station organizer and sports bottle holder which is of a durable and reliable construction.

An even further object of the present invention is to provide a new multi-station organizer and sports bottle holder which is susceptible of a low cost of manufacture with regard to both materials and labor, and which accordingly is then susceptible of low prices of sale to the consuming public, thereby making such multi-station organizer and sports bottle holder economically available to the buying public.

Still yet another object of the present invention is to provide a new multi-station organizer and sports bottle holder which provides in the apparatuses and methods of the prior art some of the advantages thereof, while simultaneously overcoming some of the disadvantages normally associated therewith.

Still another object of the present invention is to provide a new multi-station organizer and sports bottle holder for storing handles, straps, and bars that are used to perform different exercises on a multi-purpose exercise machine.

Yet another object of the present invention is to provide a new multi-station organizer and sports bottle holder which includes a section of peg board having a generally rectangular configuration. A mounting bracket is secured to a back surface of the section of peg board for securement of the section of peg board to a frame of a multi-purpose exercise machine. A set of pegs and hooks couple with the peg board for hanging equipment on the peg board. A sports bottle holder is adapted for coupling with the peg board for holding a beverage container on the peg board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
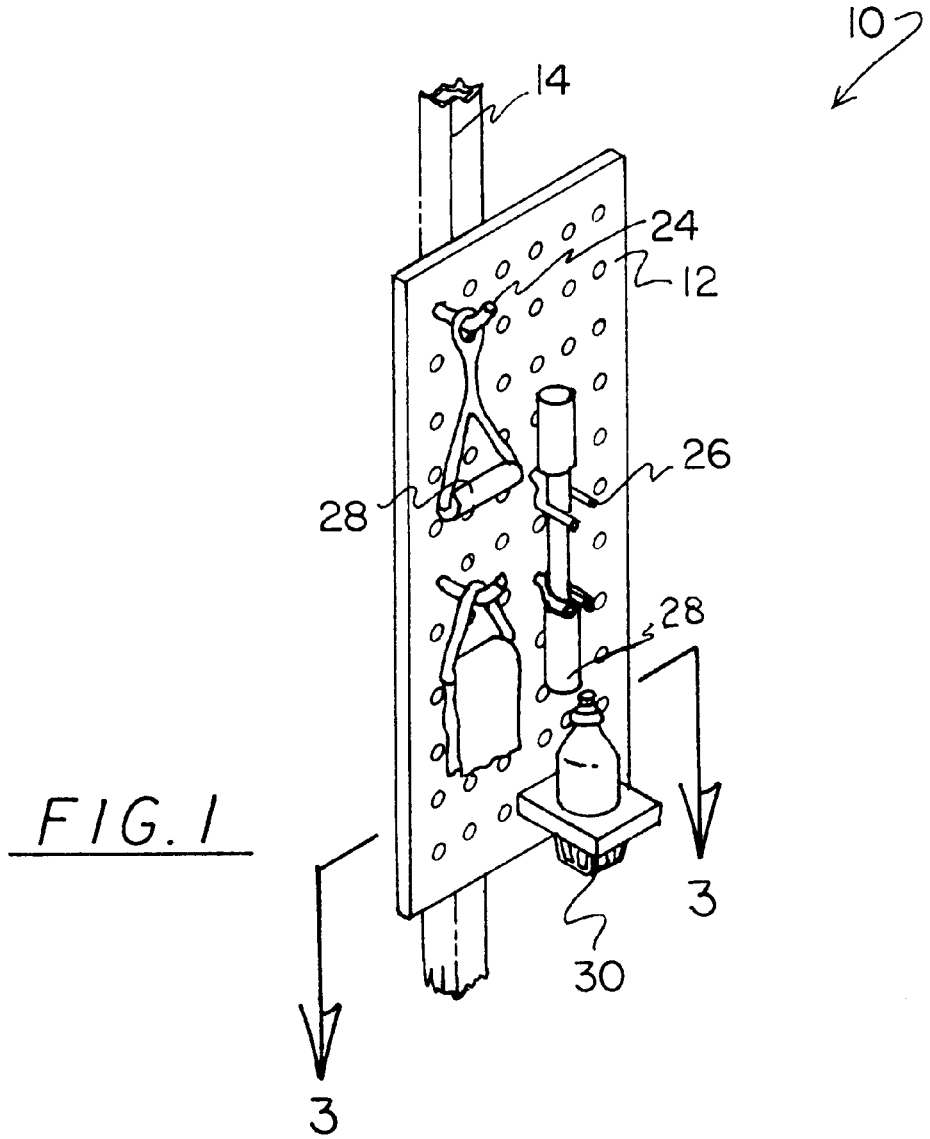
FIG. 1 is a perspective view of a new multi-station organizer and sports bottle holder according to the present invention.
Figure 2:
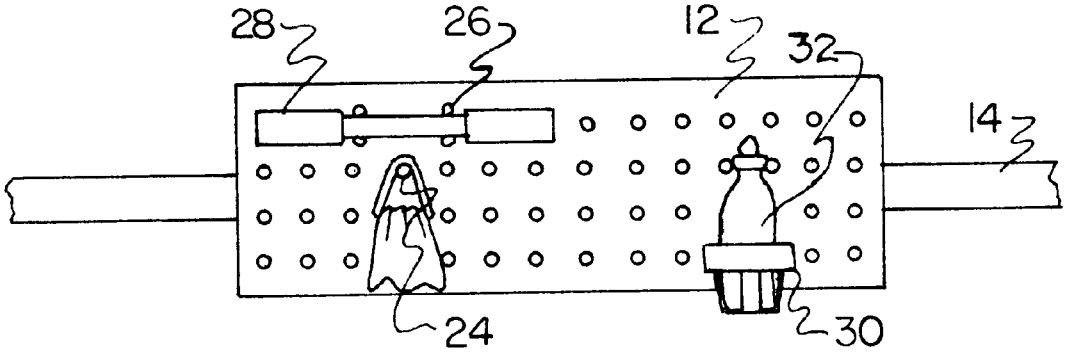
FIG. 2 is a front view of a horizontal mounting of the peg board section of the present invention.

With reference now to the drawings, and in particular to FIGS. 1 through 6 thereof, a new multi-station organizer and sports bottle holder embodying the principles and concepts of the present invention and generally designated by the reference numeral 10 will be described.

As best illustrated in FIGS. 1 through 6, the multi-station organizer and sports bottle holder 10 comprises a section of peg board 12 having a generally rectangular configuration. The section of peg board 12 can be secured to the exercise machine in vertical and horizontal orientations. Note FIGS. 1 and 2.

Figure 3:
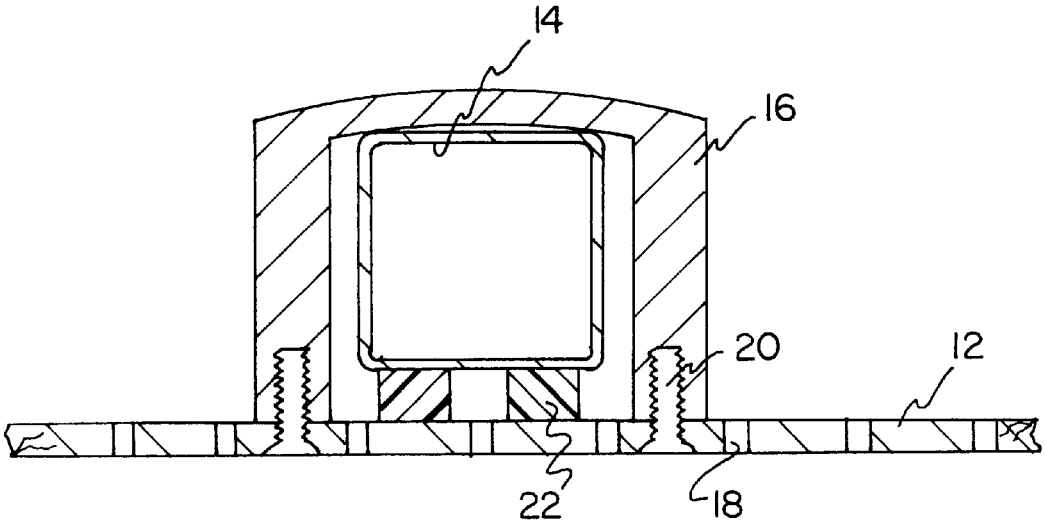
FIG. 3 is a cross-sectional view of the present invention as taken along line 3—3 of FIG. 1 illustrating mounting of the peg board to the exercise machine.

Mounting means are secured to a back surface of the section of peg board 12 for securement of the section of peg board 12 to a frame 14 of a multi-purpose exercise machine 66. FIG. 3 illustrates a movable type of mounting means that could be employed in the present invention. In this embodiment, the mounting means is comprised of a U-shaped bracket 16 that receives the frame 14 therein. Free ends of the bracket 16 have threaded apertures theretrough for aligning with two holes 18 in the peg board 12 for receiving mounting screws 20 therethrough to facilitate removable securement of the peg board 12 to the frame 14. A pair of rubber spacers 22 are positioned between the frame 14 and the peg board 12.

Figure 4:
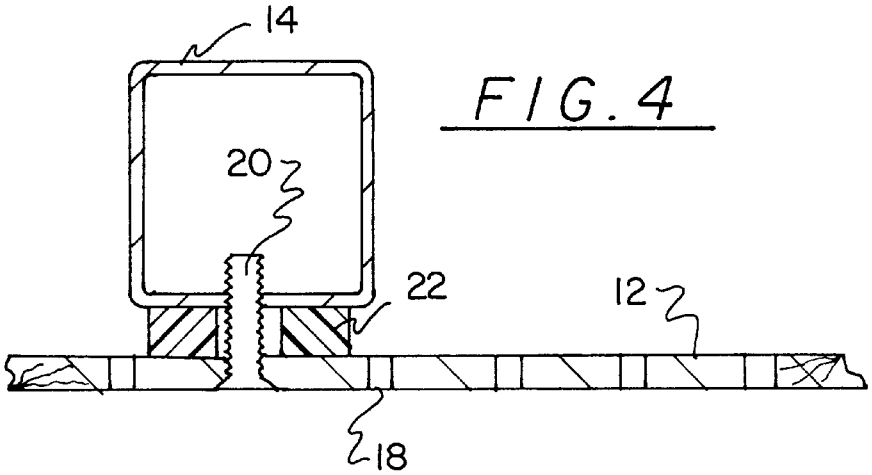
FIG. 4 is an alternate cross-sectional view of a permanent mounting of the present invention.
Figure 5:
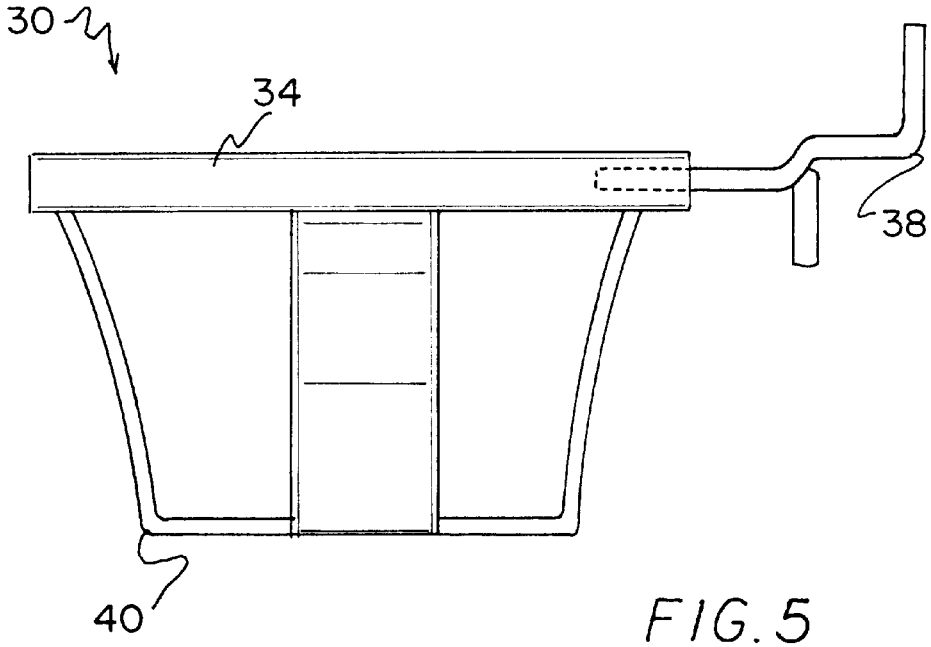
FIG. 5 is a side elevation view of the sport drink holder of the present invention.
Figure 6:
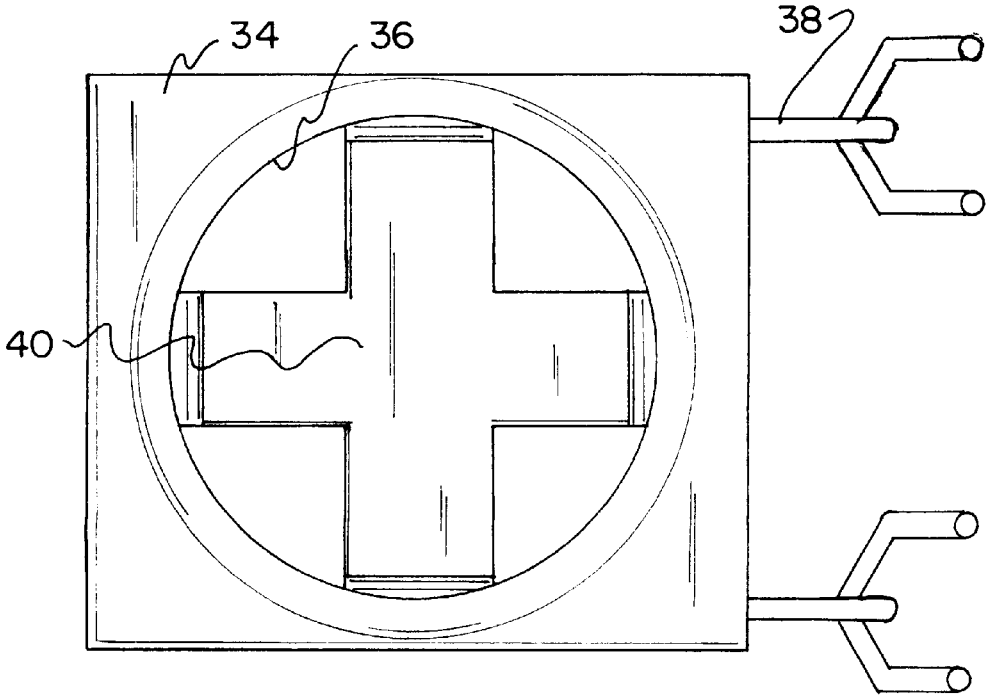
FIG. 6 is a plan view of the sport drink holder of the present invention.

FIG. 4 illustrates a permanent type of mounting means that could be employed in the present invention. In this embodiment, the mounting means is comprised of a mounting screw 20 extending through a hole 18 in the peg board 12 and engaging the frame 14. A pair of rubber spacers 22 are positioned between the frame 14 and the peg board 12.

A set of pegs 24 and hooks 26 couple with the peg board 12 for hanging equipment 28 on the peg board 12.

A sports bottle holder 30 is adapted for coupling with the peg board 12 for holding a beverage container 32 on the peg board 12. The sports bottle holder 30 is comprised of a square frame member 34 having an aperture 36 disposed centrally therethrough. The aperture 36 is dimensioned for receiving a beverage container 32 therein. The frame member 34 has a pair of hooks 38 extending outwardly of a leading edge thereof. The pair of hooks 38 engage holes 18 on the peg board 12. The sports bottle holder 30 further includes a lower cage 40 secured to and extending downwardly from the frame member 34 in communication with the aperture 36 therethrough. The lower cage 40 supports a beverage container 32 positioned within the aperture 36. Note FIGS. 5 and 6.

In use, the present invention would organize handles, bars, and straps associated with a multi-purpose weight machine so that a user does not waste time and effort looking for the desired accessory. The sports bottle holder 30 also provides a place for the user to store their drink while exercising.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-station organizer and sports bottle holder system for a multipurpose exercise machine having a frame, the frame having at least one elongated member, the multi-station organizer and sports bottle holder system comprising:

a section of peg board having a generally rectangular configuration;

a U-shaped bracket having opposite ends, said bracket adapted for securing said peg board to said elongated member of said frame of said exercise machine, said bracket adapted to receive said frame between said opposite ends, each of said opposite ends of said bracket having threaded apertures extending into an interior of said bracket;

a pair of mounting screws, each of said threaded apertures of said bracket aligning with a respective hole in said peg board for receiving a respective one of said mounting screws;

each of said mounting screws being insertable through said hole aligned with said threaded aperture for engaging said threaded aperture whereby said bracket will be coupled to said peg board around said frame to facilitate removable securement of said peg board to said elongated member of said frame;

a set of pegs and hooks coupling with said peg board for hanging equipment on said peg board;

a sports bottle holder adapted for coupling with said peg board for holding a beverage container on said peg board; and a pair of rubber spacers abutting an interior portion of a back surface of said peg board, said spacers being positioned between said frame and said peg board when said bracket is coupled to said peg board around said frame for resisting movement of said peg board with respect to said frame.

2. The multi-station organizer and sports bottle holder as set forth in claim 1 wherein said sports bottle holder is comprised of a square frame member having an aperture disposed centrally therethrough, said aperture being adapted for receiving a beverage container therein, said frame member having a pair of hooks extending outwardly of a leading edge thereof, said pair of hooks engaging holes in said peg board.

3. The multi-station organizer and sports bottle holder as set forth in claim 2, said sports bottle holder further including a lower cage secured to and extending downwardly from said frame member in communication with said aperture therethrough, said lower cage being adapted for supporting a beverage container positioned within said aperture.

4. A multi-station organizer and sports bottle holder system for attaching to a multi-purpose exercise machine for storing handles, straps, and bars in a location convenient to the multi-purpose exercise machine, the system comprising:

a section of peg board having a generally rectangular configuration;

a U-shaped bracket having opposite ends, said bracket being adapted for securing said peg board to an elongated member of a frame of an exercise machine, said bracket being adapted for receiving the frame between said opposite ends, each of said opposite ends of the bracket having threaded apertures extending into an interior of said bracket;

a pair of mounting screws, each of said threaded apertures aligning with a respective hole in said peg board for receiving a respective one of said mounting screws;

each of said mounting screws extending through said hole and engaged to a respective one of said threaded apertures whereby said bracket is adapted for coupling to said peg board around the frame to facilitate removable securement of said peg board to the frame;

a set of pegs and hooks coupling with the peg board for hanging equipment on the peg board;

a sports bottle holder coupling with the peg board for holding a beverage container on the peg board;

a pair of spacers formed of an elastomeric material, said spacers being adapted for positioning between the frame and the peg board for resisting movement of the peg board with respect to the frame;

wherein the sports bottle holder is comprised of a square frame member having an aperture disposed centrally therethrough, the aperture receiving a beverage container therein, the frame member having a pair of hooks extending outwardly of a leading edge thereof, the pair of hooks engaging holes in the peg board;

wherein the sports bottle holder further includes a lower cage secured to and extending downwardly from the frame member in communication with the aperture therethrough, the lower cage being adapted for supporting a beverage container positioned within the aperture;

said lower cage having two oppositional pairs of side walls extending downwardly from said frame member, each of said side walls being generally arcuate such that each side wall extends outwardly from an axis passing othogonally through a center of the aperture in the frame member as the side wall extends from a base of the side wall towards a top of the side wall coupled to the frame member.

* * * * *